US006043781A

United States Patent [19]

Toh et al.

[11] Patent Number: 6,043,781

[45] Date of Patent: Mar. 28, 2000

[54] LOW INSERTION LOSS CONNECTION OF AN ANTENNA TO A MOBILE RADIO WITH RETRACTABLE SWIVELING ANTENNA FEATURE

[75] Inventors: Alex Toh, San Diego, Calif.; Charlie McCarrick, Plymouth, Mass.; John Ratzel, San Diego, Calif.

[73] Assignee: Hughes Electronics Corporation, El Segundo, Calif.

[21] Appl. No.: 09/097,803

[22] Filed: Jun. 16, 1998

[51] Int. Cl.[7] ..... H01Q 1/24

[52] U.S. Cl. ..... 343/702; 343/906

[58] Field of Search ..... 343/702, 900, 343/901, 906, 715, 858, 850; 439/578, 581; 455/90, 129, 269, 575; H01Q 1/24

[56] References Cited

U.S. PATENT DOCUMENTS

| | | | |
|---|---|---|---|
| 4,136,344 | 1/1979 | Nakao et al. | 343/702 |
| 4,958,382 | 9/1990 | Imanishi | 343/702 |
| 5,440,315 | 8/1995 | Wright et al. | 343/702 |
| 5,541,617 | 7/1996 | Connolly et al. | 343/895 |
| 5,809,403 | 9/1998 | Macdonald et al. | 455/90 |
| 5,835,064 | 11/1998 | Gomez et al. | 343/702 |
| 5,859,617 | 1/1999 | Fujikawa | 343/702 |
| 5,901,367 | 5/1999 | Toh | 455/575 |

*Primary Examiner*—Hoanganh Le
*Assistant Examiner*—Tho Phan
*Attorney, Agent, or Firm*—Michael W. Sales; John T. Whelan

[57] ABSTRACT

An approach for connection of an antenna employs an antenna including at least one antenna contact; a swivel collar slidably coupleable with the antenna and including at least one collar contact; and an antenna coupler/connector insertable into the swivel collar. The approach may also be characterized as involving moving an antenna by sliding the antenna within a swivel collar, moving an antenna contact at an end of the antenna away from a swivel contact in the swivel collar; and inserting an antenna coupler/connector into the swivel collar including contacting the collar contact with a contact pad on the antenna coupler/connector. An alternative the approach may have an antenna including at least one antenna contact; a swivel collar slidably coupleable with the antenna and including at least one collar contact; a cavity enveloping the antenna when the at least one antenna contact is displaced away from the at least one collar contact, and a spring interposed between the basal end of the antenna and a basal end of the cavity for moving the antenna when the at least one antenna contact is not displaced away from the at least one collar contact.

19 Claims, 8 Drawing Sheets

LOW INSERTION LOSS CONNECTION OF AN ANTENNA TO A MOBILE RADIO WITH RETRACTABLE SWIVELING ANTENNA FEATURE

BACKGROUND OF THE INVENTION

The present invention relates to low insertion loss connection of an antenna to a mobile radio, and more particularly to low insertion loss connection of an antenna to a satellite telephone. Even more particularly, the present invention relates to low insertion loss connection of an antenna to a satellite telephone with a swivel collar that allows a retractable antenna to swivel when deployed. Even more particularly, the present invention relates to a satellite telephone with a swivel collar that has two or more fixed detente positions to allow the user to fix an angle of swivel to one of the detente positions depending on whether the user holds the telephone in a left or right hand so that the antenna is pointing approximately vertically upwards in either case. Even more particularly, the present invention relates to a satellite telephone with a swivel collar and antenna slidable within the swivel collar so that the antenna can retract into a body of the telephone for protection from the elements, and against knocks and bumps as well as to keep maintain the appearance of the telephone as neat and tidy. Even more particularly, the present invention relates to a satellite telephone with a swivel collar and antenna slidable within the swivel collar so that the antenna is in an upright position, pointing vertically upwards and more or less in a direction of a satellite, ready to receive a call even when the antenna is in a retracted position as long as the telephone is stowed upright in a shirt pocket or jacket, on a belt clip, or left standing upright on a flat surface like a desk top or table. Even more particularly, the present invention relates to a satellite telephone with a swivel collar that has an antenna matching circuit built into it to allow a relatively lesser number of connections passing through a swivel joint for better reliability than in a case where the matching circuit is separate from the antenna, and to allow the antenna to be made shorter than in another case where the matching circuit is built into the antenna.

In non-satellite transceivers, such as conventional cellular telephones, a connection to an external vehicular antenna can be made through a radio frequency connector normally located on the bottom of the telephone. In order to prevent both the phone antenna and the external vehicular antenna from radiating and/or receiving radio frequency energy at the same time, which can cause phasing and other problems, a radio frequency switch in the conventional cellular telephone switches internal connections from the telephone antenna to the external vehicular antenna connected to the radio frequency connector, when a connection is detected.

In satellite transceiver applications, such as in satellite telephones, the use of a radio frequency switch for the purpose of switching internal connections from the phone antenna to the external vehicular antenna is not desirable due to the high insertion loss of the radio frequency switch. This high insertion loss is particularly problematic in satellite telephones because of the limited loss budget due to the greater distance between the satellite telephone and an earth orbit satellite with which it communicates. In order to make up this loss on the satellite side, by building a more sophisticated satellite, extremely high costs would be involved, such as on the order of 40 million dollars.

One way in which to eliminate the radio frequency switch is to simply use a detachable connector to connect the phone's antenna to the satellite telephone, and when use of the external vehicular antenna is desired to remove the telephone antenna and to connect vehicular antenna to the site on the satellite telephone from which the telephone antenna was removed. This approach is, however, awkward and time consuming, and therefore not highly desirable.

Another approach is to employ an inductive coupler that, when the satellite telephone is inserted into a docking adaptor in the vehicle, surrounds the telephone antenna (or a portion thereof) providing an inductive link between the external antenna and the satellite telephone. This approach, however, fails to achieve direct contact or close capacitive coupling between the vehicular external antenna and the satellite telephone, and thus also suffers from high insertion loss.

Another difficulty faced in a satellite telephone environment is the need to angle adjust or swivel the telephone antenna. This ability to angle adjust the antenna so as to aim the antenna toward the satellite with which it is communicating is needed because the telephone antenna's gain pattern is directional, and in a hand-held satellite telephone, a user is limited as to the angle at which the satellite telephone can be held in order to aim the antenna while at the same time maintaining the satellite telephone itself in a useable position near the user's ear and mouth.

As a result, all presently-available satellite telephones, and most global positioning system receivers for that matter, include a swivel joint at the attachment of antenna to the telephone or receiver. When the antenna is completely folded against the satellite telephone or global positioning system receiver's housing, it is in a storage position, and by swiveling the antenna up so as to aim it at the satellite or satellites with which it is communicating, the antenna is placed into a deployed position.

This approach however fails to address the problem that the antenna is alongside the housing of the telephone in the stowed position and not adequately protected from the elements and against knocks and bumps, as well as not in line with the appearance of a whole and integral unit. This approach also fails to address the problem that the antenna is not able to receive a call when it is in the stowed position because it is pointing in a wrong direction.

Another approach is to have a telescoping antenna, similar to antennas commonly used with portable AM/FM broadcast radio receivers, where a lower antenna element pivots relative to a housing body. This approach, however, fails to allow the antenna to slide into the housing of the radio for full retraction and protection.

Yet another approach is to have a pivot on the antenna element itself with the antenna and pivot together slidable into a channel of the radio receiver's housing body. This approach, however, adds to the length of the antenna because a matching circuit has to be placed within the antenna element above the pivot, as a connection between the matching circuit and the antenna has to be rigid for impedance matching, and therefore cannot be routed through the swivel joint.

The present invention advantageously addresses the above and other needs.

SUMMARY OF THE INVENTION

The present invention advantageously addresses the needs above as well as other needs by providing a low insertion loss connection of an antenna to a mobile radio.

In one embodiment, the invention can be characterized as a system for connection of an antenna to a mobile radio.

Such embodiment employs an antenna including at least one antenna contact at a basal end thereof; a swivel collar slidably coupleable with the antenna and including at least one collar contact alignable with the at least one antenna contact when the antenna is in an extended position. In a variation of the present embodiment, the system includes an antenna coupler/connector insertable into the swivel collar. The antenna coupler/connector includes an end for displacing the antenna contact away from the collar contact. The antenna coupler/connector includes at least one coupler pad alignable with the antenna feedpoint when the antenna contact is displaced away from the antenna feedpoint.

In another embodiment, the invention can be characterized as a method for connection of an antenna to a mobile radio. The method involves the steps of moving an antenna by rotating the antenna with a swivel collar and then sliding the antenna within the swivel collar, the sliding including moving the antenna from an extended position to a retracted position including moving an antenna contact at a basal end of the antenna away from a collar contact in the swivel collar. In a variation of the present embodiment, the system includes inserting an antenna coupler/connector into the swivel collar including moving the antenna from the retracted position to a depressed position, and further including contacting or capacitively coupling the collar contact in the swivel collar with a contact pad on the antenna coupler/connector.

In an even further embodiment, the invention can be characterized as a system for connection of an antenna to a mobile radio. The system of this embodiment has an antenna including at least one antenna contact at a basal end; a swivel collar slidably coupleable with the antenna and including at least one collar contact alignable with the at least one antenna contact when the antenna is in an extended position; a cavity enveloping the antenna when the at least one antenna contact is displaced away from the at least one collar contact; and a spring interposed between the basal end of the antenna and a basal end of the cavity for moving the antenna from a depressed position into a retracted position when the at least one antenna contact is not displaced away from the at least one collar contact.

BRIEF DESCRIPTION OF THE DRAWINGS

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE PREFERRED EMBODIMENTS

The following description of the presently contemplated best mode of practicing the invention is not to be taken in a limiting sense, but is made merely for the purpose of describing the general principles of the invention. The scope of the invention should be determined with reference to the claims.

Figure 1:
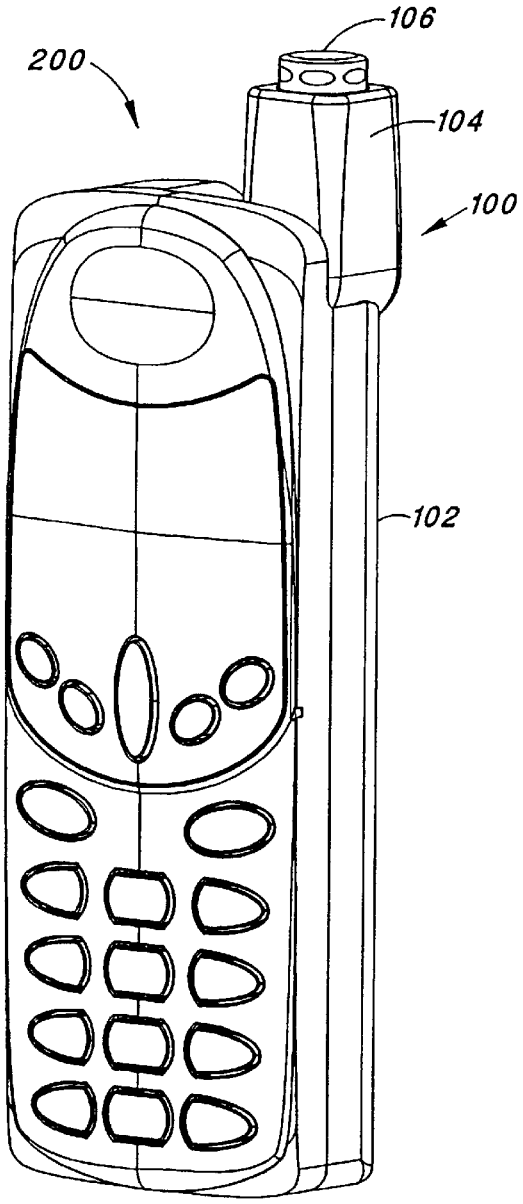
FIG. 1 is a front perspective view of a satellite telephone having a retractable antenna with a swiveling feature.

Referring to FIG. 1, a front perspective view is shown of a satellite telephone 100 having a low insertion loss retractable antenna 106 with a swiveling feature. Shown is a satellite telephone housing body 102, a swivel collar 104 and the antenna 106 in a retracted position.

Figure 2:
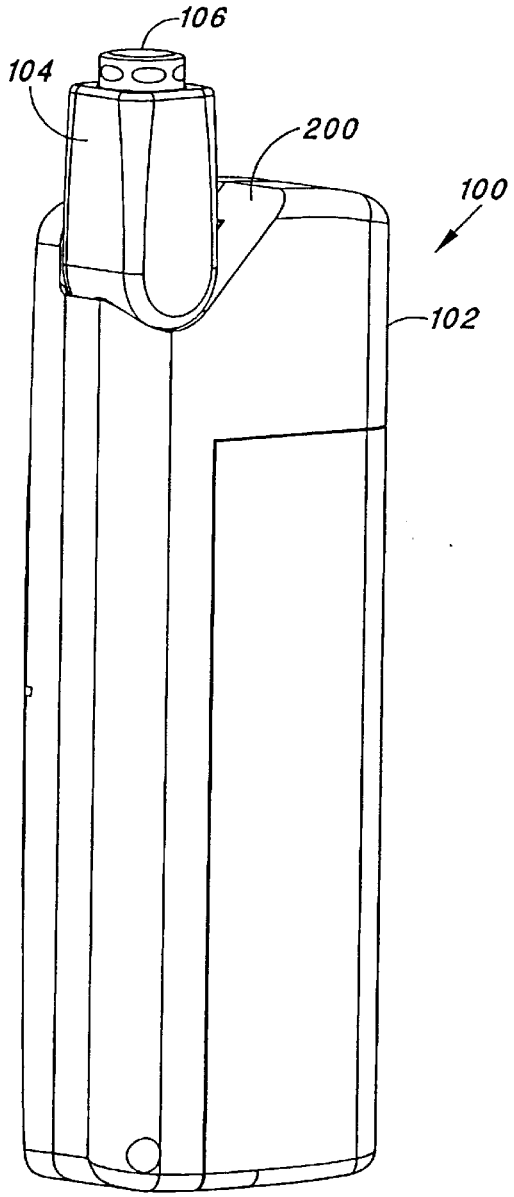
FIG. 2 is a back and side perspective view of the satellite telephone of FIG. 1.

Referring to FIG. 2, a back and side perspective view is shown of the satellite telephone 100. Shown is the satellite telephone housing body 102, the swivel collar 104, and the antenna 106 in the retracted position. As can be seen, an angular notch 200 adjacent to the swivel collar 104 in the satellite telephone housing body 102 provides clearance for the swivel collar 104 to swivel toward the satellite telephone housing body 102, as well as away from the satellite telephone housing body 102.

Figure 3:
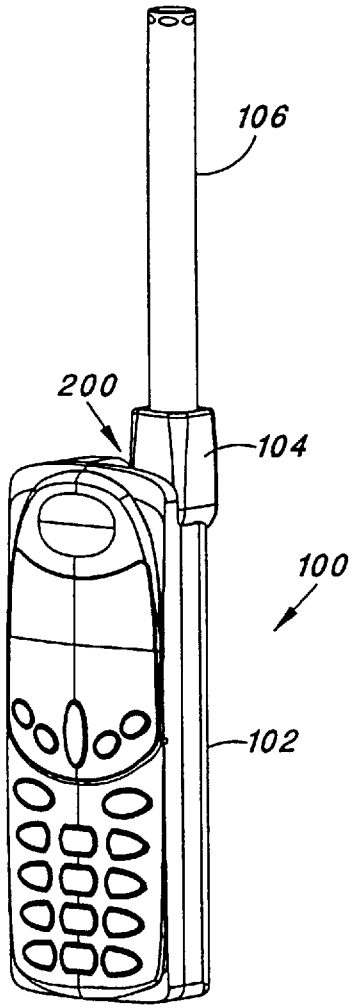
FIG. 3 is a front perspective view of the satellite telephone of FIG. 1 with the antenna fully extended.

Referring to FIG. 3, a front perspective view is shown of the satellite telephone 100. Shown are the satellite telephone housing body 102, the swivel collar 104, the antenna 106 in an extended position, such as would be the case while the satellite telephone is in use, and the angular notch 200. As shown, the swivel collar 104 and antenna 106 are in a vertical orientation, which would generally only be used for, and, in accordance with the present embodiment, must be used for, extending or retracting the antenna 106.

Figure 4:
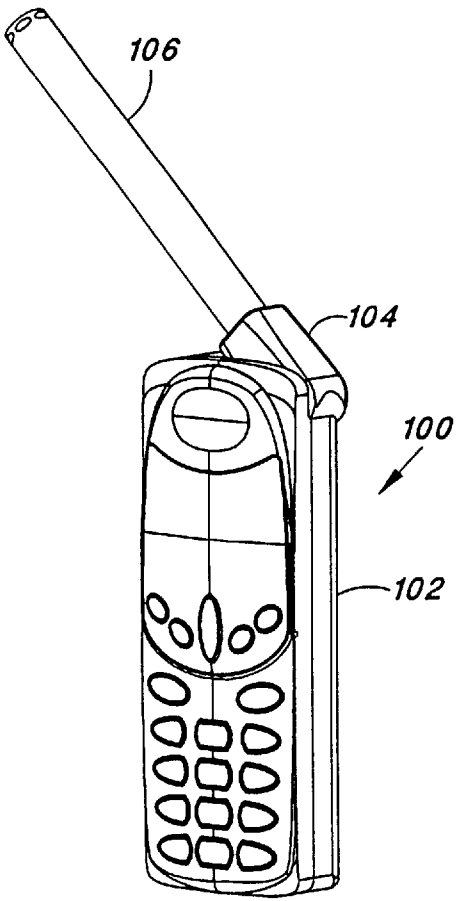
FIG. 4 is a perspective view of a satellite telephone in FIG. 1 with the antenna fully extended and swiveled to the left (as oriented in FIG. 4)

Referring to FIG. 4, a perspective view is shown of the satellite telephone 100 with the antenna 106 fully extended and swiveled to the left. Shown are the satellite telephone housing body 102, the swivel collar 104 and the antenna 106. The swivel collar 104 is rotated to the left, i.e., counter-clockwise as oriented in FIG. 4, so as to position the antenna 106 such that it will be in an approximately vertical orientation when the satellite telephone 100 is held proximate to a user's right ear and mouth in the user's right hand.

Figure 5:
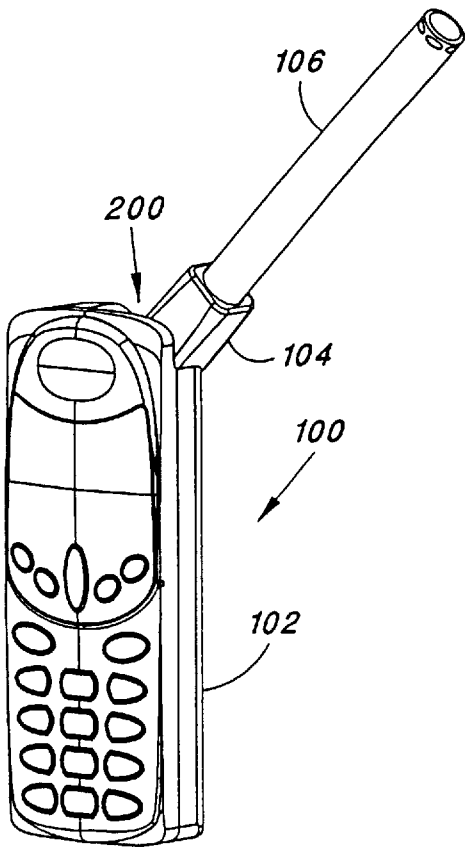
FIG. 5 is a perspective view of the satellite telephone of FIG. 1 with the antenna fully extended and swiveled to the right (as oriented in FIG. 4)

Referring to FIG. 5, a perspective view is shown of the satellite telephone 100 with the antenna 106 fully extended and swiveled to the right. Shown are the satellite telephone housing body 102, the swivel collar 104, and the antenna 106 in an extended position and rotated to the right or clockwise as oriented in FIG. 5, so as to position the antenna 106 such that it will be in an approximately vertical orientation with the satellite telephone 100 is held proximate to a user's left ear and mouth in the user's left hand.

Figure 6:
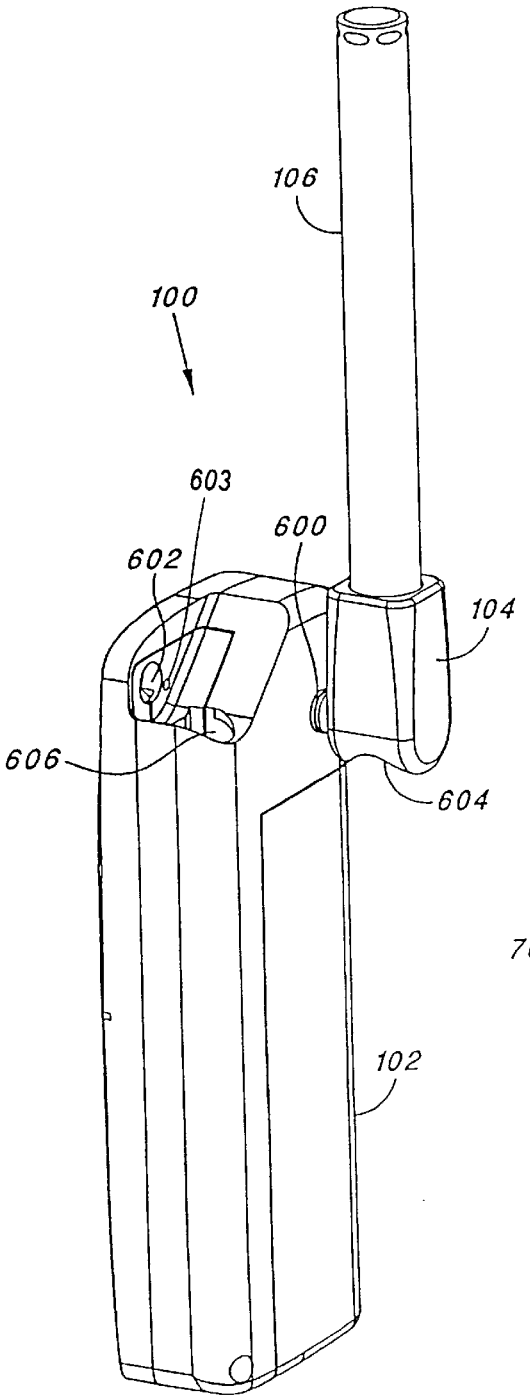
FIG. 6 is a side assembly view of the satellite telephone in FIG. 1 showing a swivel collar as it is assembled into the satellite telephone.

Referring to FIG. 6, a side assembly view is shown of the satellite telephone 100 with the swivel collar 104 shown as it is assembled into the satellite telephone. Shown are the satellite telephone housing body 102, the swivel collar 104 and the antenna 106 in an extended position. The swivel collar 104 depicted as it is assembled to the satellite telephone housing body 102 in an assembly view. A swivel pin 600 on the swivel collar 104 is shown as is a swivel hole 602 in the satellite telephone housing body 102.

In practice, the swivel pin 600 on the swivel collar 104 is inserted into the swivel hole 612 in the satellite telephone housing body 102 and a metal retainer (not shown) is secured onto the swivel pin 600 within the satellite telephone housing body 102 so as to secure the swivel collar 104 to the satellite telephone housing body 102 while at the same time allowing the swivel collar 104 to rotate about an axis coaxial with the swivel pin 600. An opening 604 in a bottom of the swivel collar permits the antenna 106 to be pushed through the swivel collar 104 down into another hole 606 in the satellite telephone housing body 102 when it is in a depressed position. Note that alignment of this hole 606 in the swivel collar 104 with the hole 606 in the satellite telephone housing body 102 is achieved when the antenna 106 and swivel collar 104 are in an upright or vertical position, such as depicted in FIG. 3. This alignment is required before the antenna can be depressed into the satellite telephone housing body 102 in accordance with the present embodiment.

Figure 7:
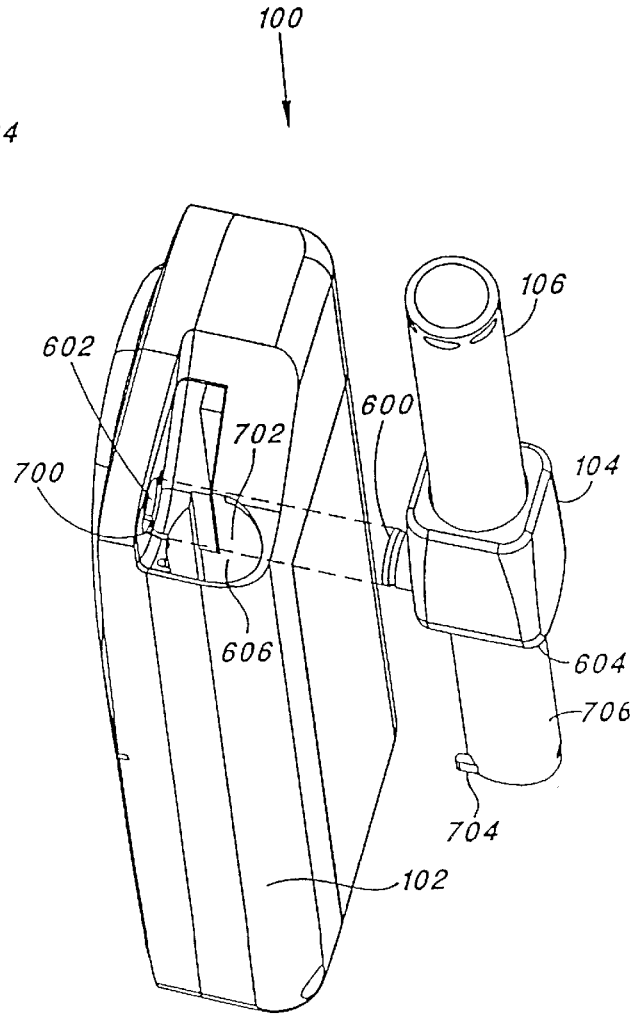
FIG. 7 is an assembly top view of the satellite telephone of FIG. 1 showing the swivel collar as it is assembled into the satellite telephone.

Referring to FIG. 7, a top assembly view is shown depicting insertion of the swivel pin 600 into the swivel hole 602 in the satellite telephone housing body 102. Shown are the satellite telephone housing body 102, the swivel collar 104, and the swivel pin 600, a key guide 700 along a cylindrical channel 702 in the satellite telephone housing body 702 and a key 704 on a base 706 of the antenna 106. The swivel collar 104 is shown in an assembly view relative to the satellite telephone housing body 102 with dashed lines indicating the positioning of the swivel pin 600 in the hole 602 in the satellite telephone housing body 102. The antenna 106 is shown in a partially depressed state for illustration purposes, so as to depict the antenna 106 protruding through the hole 604 in the bottom of the swivel collar and further to show the key 704 at the base 706 of the antenna. The key 704, together with the key guide 700 in the cylindrical channel 702 of the satellite telephone housing body 102, prevent rotation of the antenna 106 about its major axis so as to assure alignment of contacts (not shown) on the antenna with contacts (not shown) within the swivel collar 104.

The channel 702 in the satellite telephone housing terminates at the hole 606, described above in reference to FIG. 6.

Figure 8:
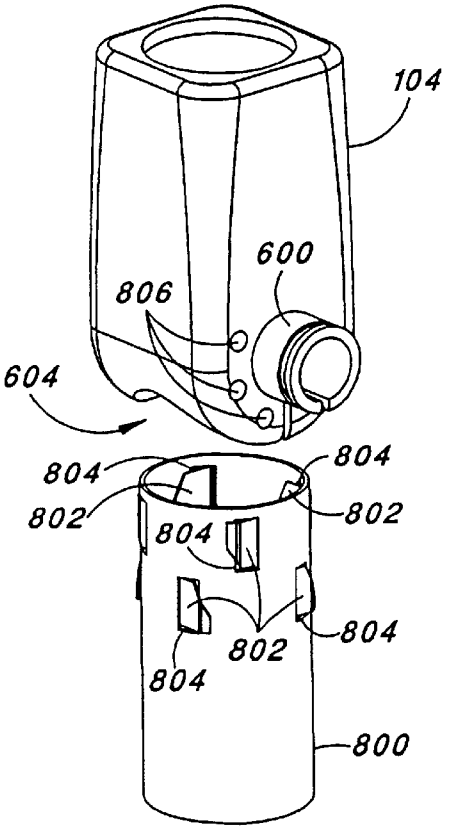
FIG. 8 is a side assembly view of the swivel collar of FIGS. 6 and 7 showing insertion of a sleeve into the swivel collar and placement of a contact strip (and matching circuit) in the sleeve.

Referring to FIG. 8, as assembly view is shown of the swivel collar 104 of FIGS. 6 and 7 showing insertion of a sleeve 800 into the swivel collar 104 and placement of a contact strip 802 into the sleeve 800. Shown are the swivel collar 104 and the swivel pin 600 with the sleeve 800 shown in an assembly view relative to the swivel collar 104 so as to illustrate both insertion of the sleeve into the hole 604 of the base of the swivel collar 104 and insertion of the contact strips 802 into four pairs of locating slots 804 in the sleeve 800. The contact strips 802 connect four quadrifilar antenna elements (not shown) on the antenna 106 (FIG. 1) to the contact strips 802 on a feedflex circuit. The contact strips 802 are four in number, and have a middle span exposed inside the sleeve 800. This middle span, having been secured in the locating slots 804, forms a leaf spring contact providing an inward spring force that assumes good contact with the quadrifilar elements (not shown) of the antenna 106 (FIG. 1). Thus, the middle spans of the respective contact strips 802 are exposed inside the sleeve 800 and will, in practice, contact the quadrifilar elements on the antenna 106 when the antenna is in an extended position. Also shown in FIG. 8 are a series of detents 806 on the swivel collar 104 that correspond with a pin 603, FIG. 6, on the satellite telephone housing body 102 so as to selectively hold the swivel collar 104 in particular rotational orientations while the antenna 106 is in the extended position. The detents 806 also help to align the antenna 106 and swivel collar 104 in an upright or vertical position (such as in FIG. 3) which is required for insertion of the antenna into the swivel collar 104 and into the channel 702 in the satellite telephone housing body 102.

Figure 9:
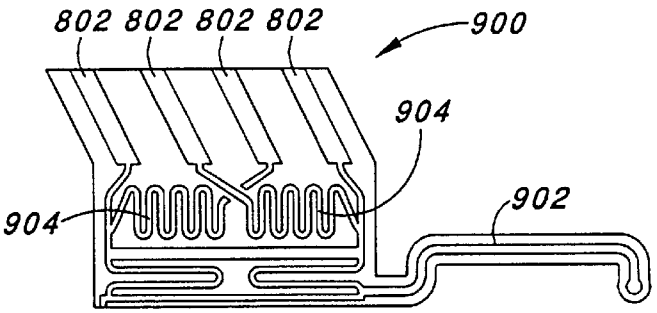
FIG. 9 is a front view of a feed flex circuit including the contact strips of FIG. 8 in a flattened state, showing a matching circuit, and showing a connection lead for connecting to electronics within the satellite telephone of FIG. 1.

Referring to FIG. 9, a front view is shown of the feedflex circuit 900 including the contact strips 802 in a flattened state and is also of a connection lead 902 for correcting to electronics within the satellite telephone housing body 102. Shown is the flex circuit 900, prior to being rolled into a cylinder and inserted into the sleeve 800 (FIG. 8).

On the feedflex circuit 900 are the four contact strips 802 that are inserted into the alignment slots 804 in the sleeve 800. Also shown are matching circuits 904 feeding the four contact strips 802. And, also shown is the connection lead 902 through which the feedflex circuit 900 is connected to the electronic circuitry within the satellite telephone housing body 102 (FIG. 1). As an alternative to the connection lead 902, a coaxial cable connection can be used to correct the feedflex circuit 900 to the electronics within the housing body 102 (FIG. 1).

Figure 10:
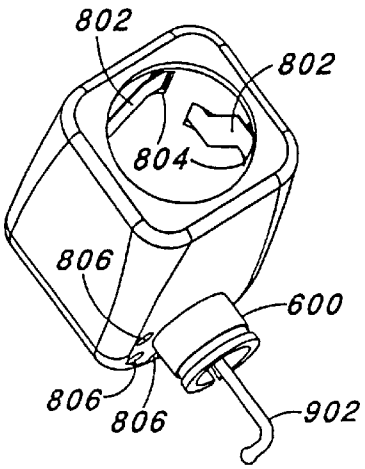
FIG. 10 is a top perspective view of the swivel collar showing interior placement of the contact strip in the sleeve, and a swivel pin through which the connection lead on the contact strip passes to connect to the electronics within the satellite telephone.

Referring to FIG. 10, a top perspective view is shown of interim placement of the contact strips 802 within the sleeve 800, and the swivel pin 600 with the connection lead 902 on the feedflex circuit 900 passing therethrough. Shown are the swivel collar 104, the sleeve 800, the middle spans of contact strips 802 on the feedflex circuit 900, and the swivel pin 600. Also shown are the connection lead 902, the locating slots 804, the detents 806 for locking the swivel collar 104 into different rotational positions in order to assist users in setting the antenna 106 to specific usage angles. As shown, the swivel pin 600 is hollow, allowing the connection lead 902 from the feedflex circuit 900 to pass through a center of the swivel pin to electronics within the satellite telephone housing body 102 (FIG. 1). Four leaf springs are created by the middle spans of the four contact strips 802 of the feedflex circuit 900 as they pass through the locating slots 804 in the sleeve 800 so as to facilitate contact between the contact strips 802 and the quadrifilar elements on the antenna 106.

Figure 11:
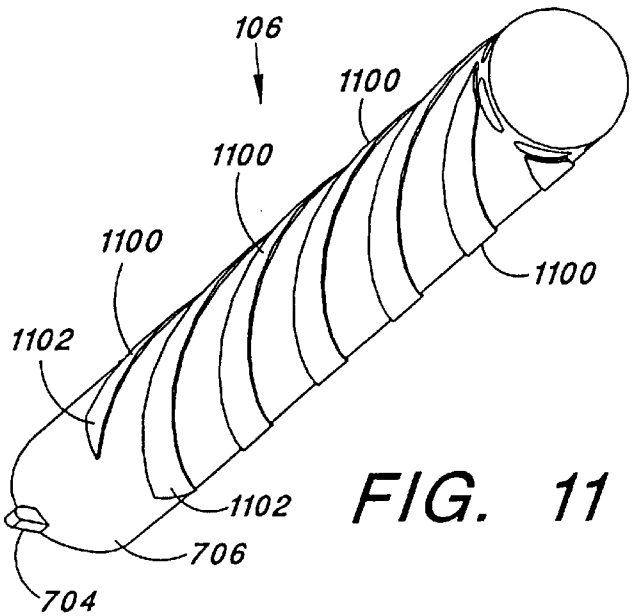
FIG. 11 is a perspective view of the antenna having been removed from the swivel collar so as to show quadrifilar antenna elements having exposed ends that make contact with the contact strip within the swivel collar.

Referring next to FIG. 11, a perspective view is shown of the antenna 106 having been removed from the swivel collar 104 so as to show the quadrifilar elements 1100 that contact the contact strips 802. Shown is the antenna with the four quadrifilar elements 1100 in a helical pattern around the antenna 106. Short lengths 1102 of the quadrifilar elements 1100 near the base 706 of the antenna 106 are exposed so as to allow contact between the middle spans of the contact strips 802 and the exposed short lengths 1102 of the quadrifilar elements 1100. Also shown in FIG. 11 is the key 704 used to prevent rotation of the antenna 106 about its major axis when the antenna 106 is retracted into and extended from the channel 606 in the satellite telephone housing body 102. The key 704 also serves to prevent the antenna 106 from sliding completely out of the satellite telephone housing and swivel collar 104 when the antenna is extended from the satellite telephone housing body 102.

Figure 12:
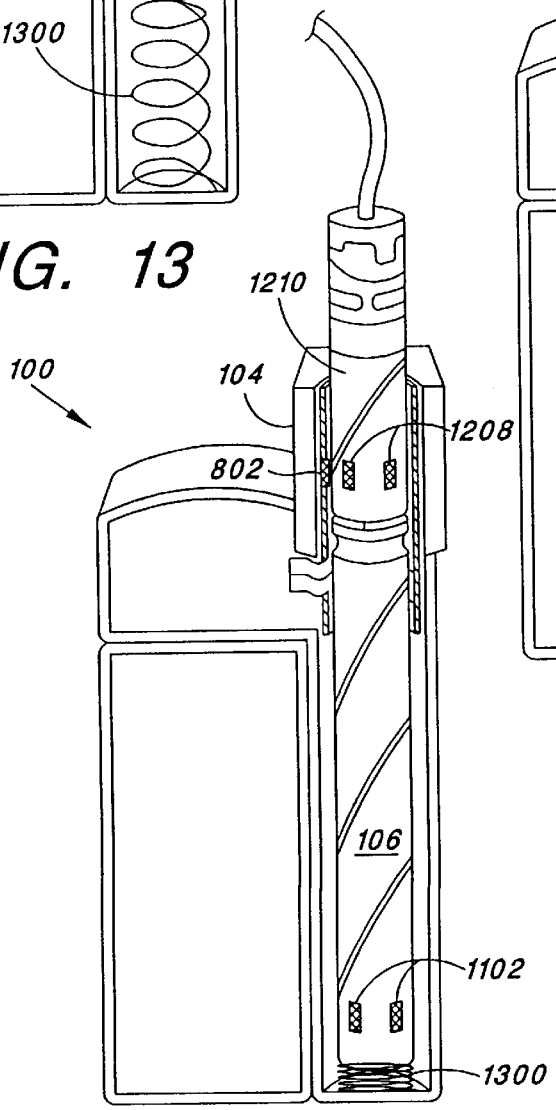
FIG. 12 is a cross-sectional view of the satellite telephone of FIG. 15, with an antenna coupler/connector inserted therein so as to move a satellite telephone antenna into a depressed position, such as would be the case when the satellite telephone is inserted into the docking adaptor.
Figure 15:
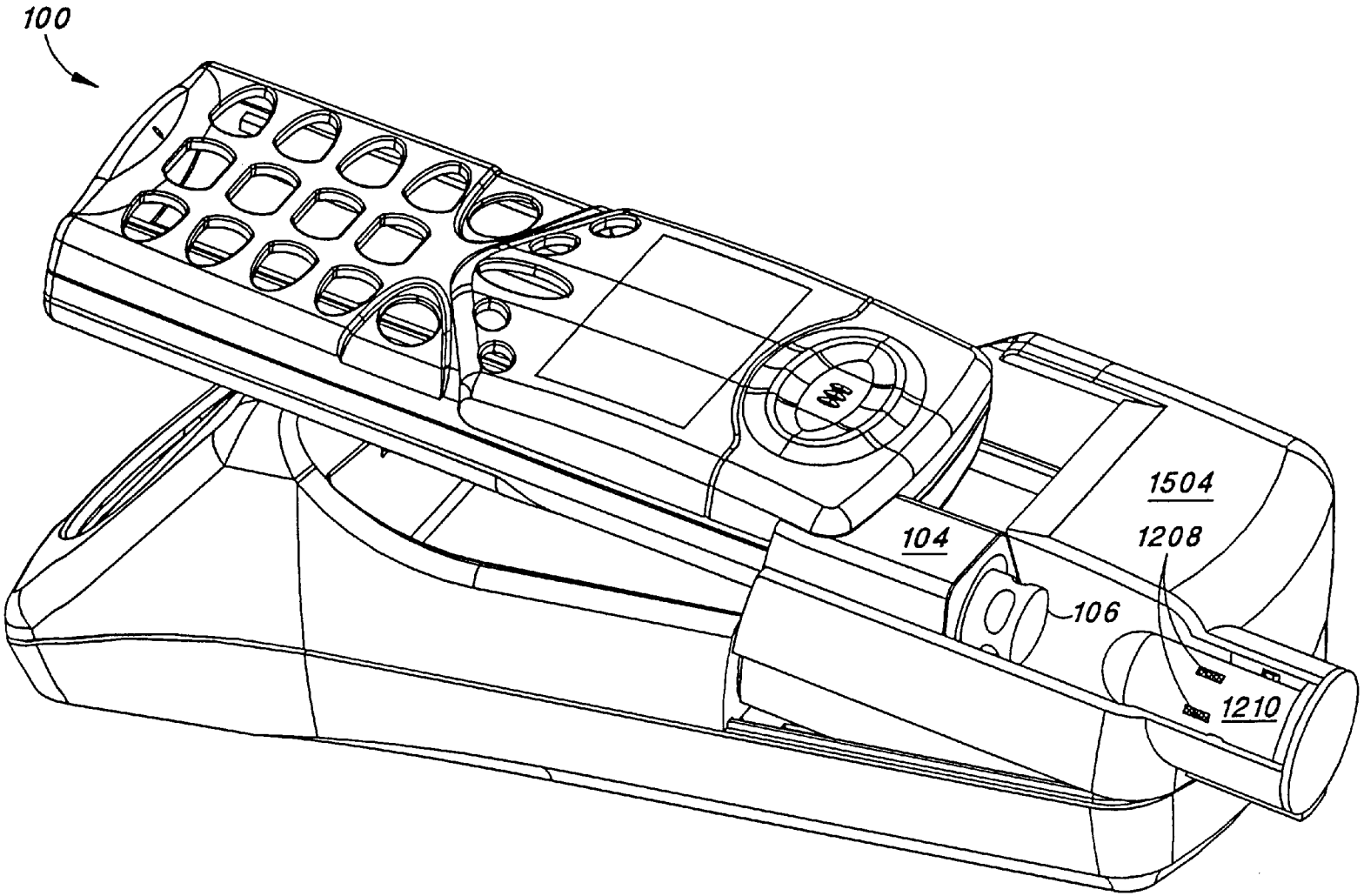
FIG. 15 is a perspective view, partially in section, of the satellite telephone of FIG. 1 as it is inserted into a docking adaptor.

Referring next to FIG. 12, a cross-sectional view is shown of the satellite telephone 100, with an antenna coupler/connector 1210 inserted therein so as to move the satellite telephone antenna 106 into a depressed position, such as would be the case when the satellite telephone 100 is inserted into a docking adaptor 1202 (FIG. 15). Shown are the antenna coupler/connector 1210, the antenna 106, the swivel collar 104 (which may alternatively be a fixed antenna collar such as is described in U.S. Pat. No. 5,901,367, incorporated herein by reference.) the contact pads 1208, and a spring 1300.

As can be seen, the antenna coupler/connector 1210 displaces the antenna 106 downwardly, thereby depressing the spring 1300, so as to move the satellite telephone antenna 106 away from the swivel collar 104. In moving the satellite telephone antenna 106 away from the swivel collar 104, the satellite telephone antenna 106 is also moved away from the contact strips 802, which, upon insertion of the antenna coupler/connector 1210, are connected to the contact pads 1208 on the antenna coupler/connector 1210 by means of a direct contact or capacitive coupling, thereby providing a connection between the satellite telephone 100 and an external vehicular antenna (not shown). In this position the satellite telephone antenna 106 is disabled, and the external vehicular antenna (not shown) is ready for use such as when the satellite telephone 100 is used in a vehicular, docked mode. The external vehicular antenna 5is coupled to the antenna coupler/connector 1210 via a coaxial cable 1502.

Figure 13:
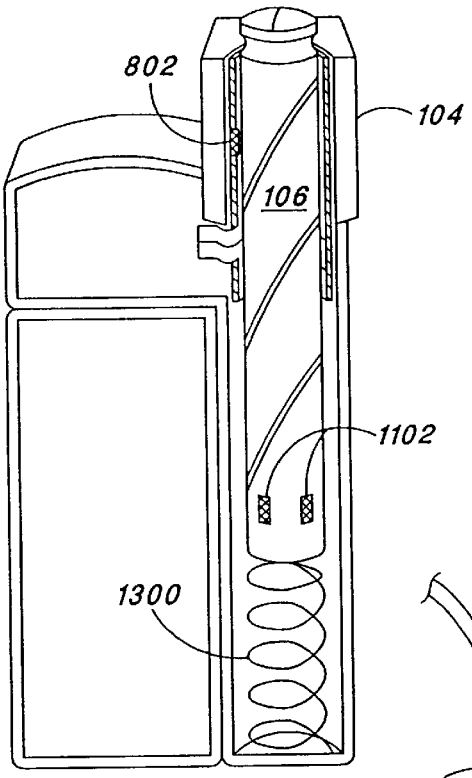
FIG. 13 is a cross-sectional view of the satellite telephone of FIG. 1, with an antenna coupler/connector removed and the satellite telephone antenna pushed upwardly by a spring into a retracted position.

Referring next to FIG. 13, a cross-sectional view is shown of the satellite telephone 100, with the antenna coupler/connector (not shown) removed and the satellite telephone antenna 106 pushed upwardly by the spring 1300 into a retracted position. Shown are the satellite telephone antenna 106, the swivel collar 104, the contact strips 802 and the spring 1300. In the position shown, i.e., the retracted position, an end of the satellite telephone antenna 106 is reachable by a user of the satellite telephone 100, such that the satellite telephone antenna 106 can be extended from the satellite telephone 100. However, in the retracted position, the satellite telephone antenna 106 remains out of the way of the user, and is protected from potential damage during handling of the satellite telephone 100.

Figure 14:
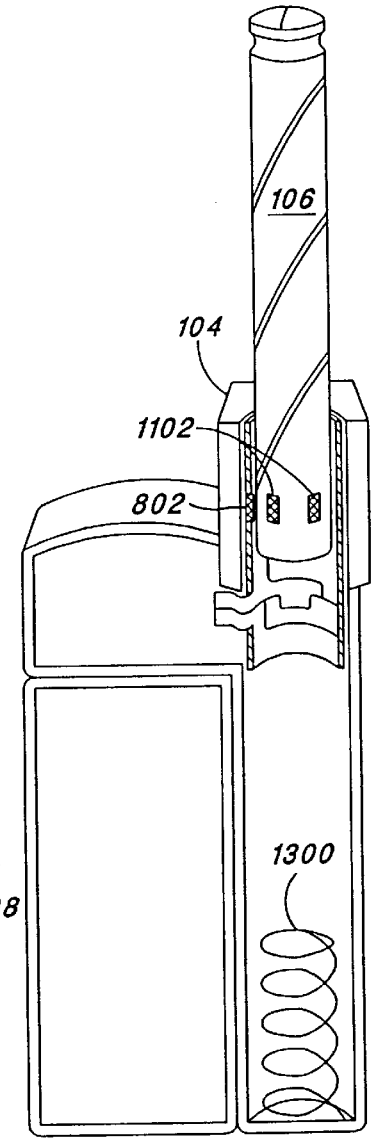
FIG. 14 is a cross-sectional view of the satellite telephone of FIG. 1 wherein the satellite telephone antenna is in an extended portion.

Referring next to FIG. 14, a cross-sectional view is shown of the satellite telephone 100 when the satellite telephone antenna 106 is in an extended position. Shown are the antenna 106, the swivel collar 104, the contact strips 802, and the spring 1300. Also shown are the exposed short lengths 1102 on the satellite telephone antenna 106. In the extended position, which is achieved by the user pulling the end of the satellite telephone antenna 106 from the retracted position into the extended position by grasping the end of the satellite telephone antenna 106 while the satellite telephone antenna is in the retracted position and extending the satellite telephone antenna 106, the exposed short lengths 1102 at the base 706 of the satellite telephone antenna 106 contact or become capacitively coupled with the connection strips 802, thereby coupling the satellite telephone antenna 106 to the satellite telephone 100. In this position, the satellite telephone antenna 106 is ready for use, such as when the satellite telephone 100 is used in a mobile, hand-held mode.

In particular, and as illustrated in FIGS. 12 through 14, it should be noted that the exposed short lengths 1102 are moved a significant distance away from the connection strips 802 when the satellite telephone antenna 106 is in the depressed position (FIG. 12) and the antenna coupler/connecter 1210 is inserted into the satellite telephone 100. This distance can be important in order to prevent capacitive or inductive coupling between the connection strips 802 and the exposed short lengths 1102 during operation in docked mode, which would result in high insertion losses. When the satellite telephone antenna 106 is in the extended position, however, the exposed short lengths 1102 are brought into contact with or into extremely close proximity with the connection strips 802 so as to couple the satellite telephone antenna 106 to the satellite telephone 100 with very little insertion loss.

Referring first to FIG. 15, a perspective view is shown, partially in section, of a satellite telephone 100 as it is inserted into a docking adaptor 1502. Shown are a swivel pocket 1504, the swivel collar 104, contact pads 1208, an antenna coupler/connector 1210 and the satellite telephone antenna 106.

The antenna coupler/connector 1210 engages as the satellite-telephone 100 is docked into the docking adaptor 1502. The swivel pocket 1504 guides the satellite telephone 100 into the docking adaptor 1202 and lines up the swivel collar 104 with the antenna coupler/connector 1210 for blind insertion. The contact pads 1208 contact or become capacitively coupled with the connection strips 802 on the inside wall of the swivel collar 104 as the antenna 106 is inserted into the swivel collar 104 The antenna coupler/connector 1210 pushes the satellite telephone antenna 106 into the satellite telephone 100 as the satellite telephone 100 is inserted into the swivel pocket 1504.

Figure 16:
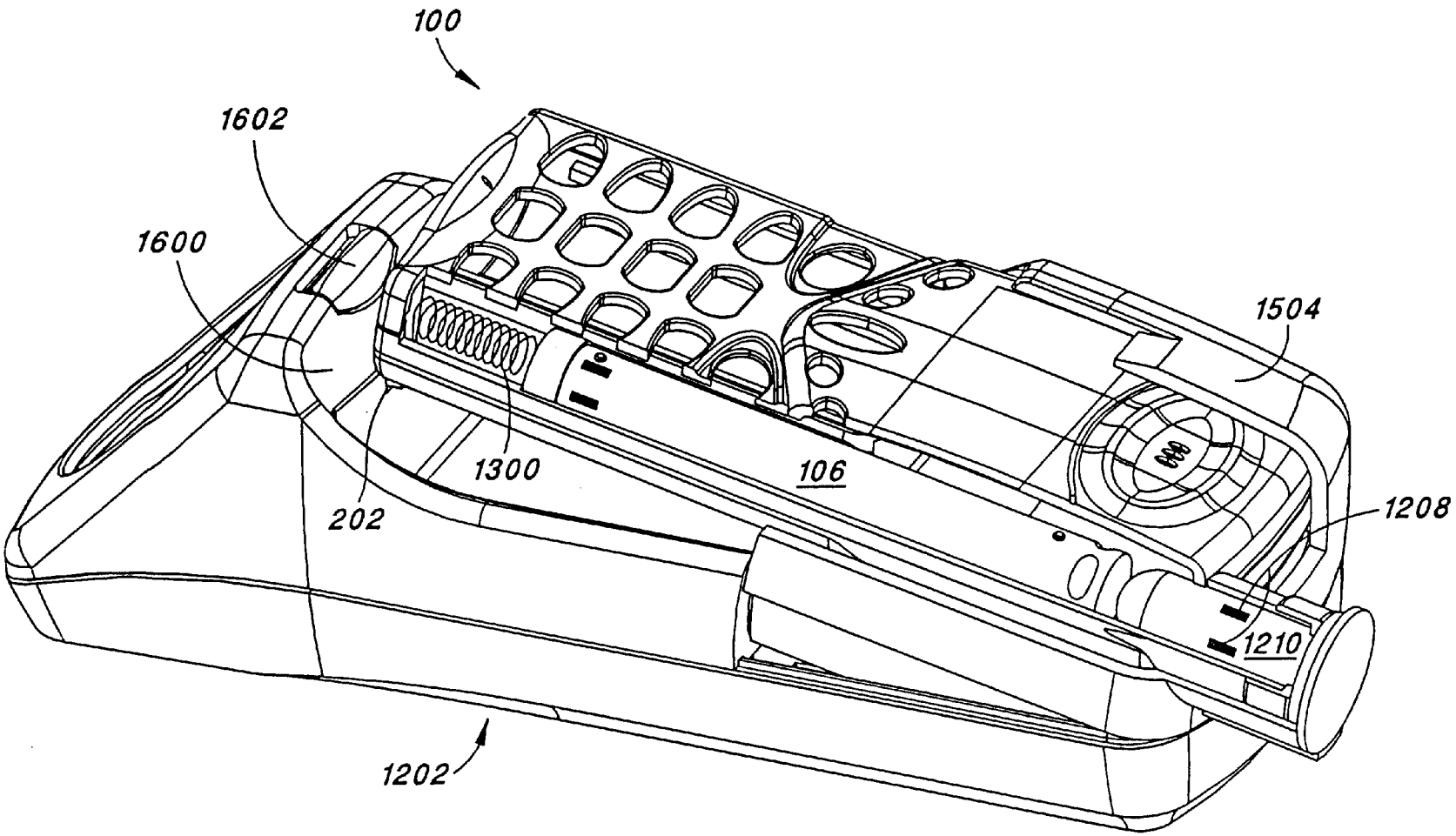
FIG. 16 is a perspective view, partially in section, of the satellite telephone of FIG. 1 fully inserted into a swivel pocket of the docking adaptor.

Referring next to FIG. 16, a perspective view is shown, partially in section, of the satellite telephone 100 fully inserted into the swivel pocket 1504. Shown are the satellite telephone antenna 106, the swivel pocket 1504, the contact pads 1208, the antenna coupler/connector 1210 and the satellite telephone 100. Also shown is the spring 1300 within the satellite telephone 100 that normally holds the satellite telephone antenna 106 in a position at least partially protruding from the satellite telephone 100. The satellite telephone antenna 106 is pushed into the satellite telephone 100 by the antenna coupler/connector 1210, thus depressing the spring 1300, so as to allow the antenna coupler/connector 1210 to connect the connection strips 802 in the swivel collar 104 to the contact pads 1208. Thus, the pads 1208 inside the swivel collar 104 connect to the satellite telephone antenna 106 when the satellite telephone antenna 106 is deployed, i.e., extended, but connect to the contact pads 1208 of the antenna coupler/connector 1210 when the antenna coupler/connector 1210 is inserted into the swivel collar 104.

Figure 17:
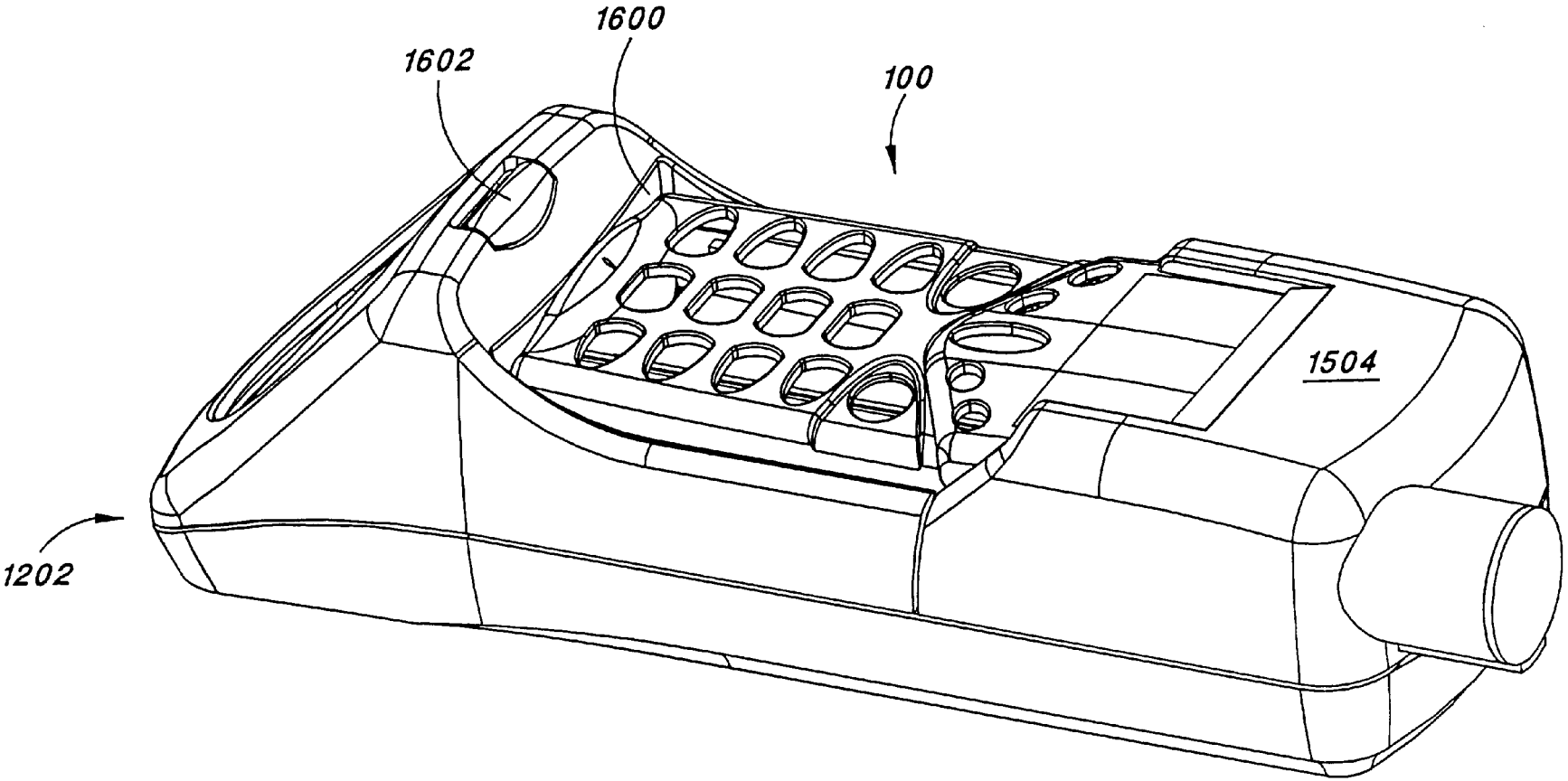
FIG. 17 is a perspective view of the satellite telephone of FIG. 1 fully inserted into the docking adaptor.

Referring next to FIG. 17, a perspective view is shown of the satellite telephone 100 fully inserted into the docking adaptor 1502. The satellite telephone 100 and the swivel pocket 1504 are pivoted down so as to lock the satellite telephone 100 into place within the docking adaptor 1502. A latch (see 1602 in FIG. 16) locks the satellite telephone 100 in a down position, and contact points (not shown) on the bottom of the satellite telephone 100 mate up with battery charging and data connector connections (not shown) on a back wall 1600 of the docking adaptor 1502 when the satellite telephone 100 is pushed down. A release button 1702 is provided to release the satellite telephone 100, which is, upon release, lifted out of the docking adaptor 1502 by the swivel pocket 1504.

While the invention herein disclosed has been described by means of specific embodiments and applications thereof, numerous modifications and variations could be made thereto by those skilled in the art without departing from the scope of the invention set forth in the claims.

What is claimed is:

1. A system for connection of an antenna to a mobile radio comprising:

the antenna including at least one antenna contact at a basal end thereof;

a swivel collar slidably coupleable with the antenna and including at least one swivel collar contact alignable with the at least one antenna contact and electrically coupled to the mobile radio when the antenna is in an extended position, the swivel collar being rotatable in at least one direction when the antenna is in the extended position;

an alignment structure coupled to the antenna for maintaining rotational alignment of the antenna about its major axis to ensure electrical coupleability of the antenna to the mobile radio; and an antenna coupler/connector insertable into said swivel collar, the antenna coupler/connector including an end for displacing the at least one antenna contact away from the at least one swivel collar contact, the antenna coupler/connector including at least one contact pad alignable with the at least one swivel collar contact when the at least one antenna contact is displaced away from the at least one swivel collar contact.

2. The system of claim 1 further comprising:

a cavity enveloping said antenna when said at least one antenna contact is displaced away from said at least one swivel collar contact.

3. The system of claim 1 further comprising:

a spring interposed between said basal end of said antenna and a basal end of said cavity for moving said antenna from a depressed position into a retracted position when said at least one antenna contact is not displaced away from said at least one swivel collar contact by the antenna coupler/connector.

4. The system of claim 1 further comprising:

a satellite transceiver coupled to said at least one swivel collar contact of said swivel collar.

5. The system of claim 4 further comprising:

a docking adaptor, the docking adaptor including an antenna coupler/connector.

6. A system of connection of an antenna to a mobile radio comprising:

the antenna including at least one antenna contact at a basal end thereof and an alignment structure for maintaining rotational alignment of the antenna about its major axis to ensure electrical coupleability of the antenna to the mobile radio;

a swivel collar slideably coupleable with the antenna and including at least one swivel collar contact alignable with the at least one antenna contact when the antenna is in an extended position, the swivel collar being rotatable about an axis substantially normal to a direction in which the antenna is slidable;

a cavity enveloping the antenna when the at least one antenna contact is displaced away from the at least one swivel collar contact; and a spring interposed between the basal end of the antenna and a basal end of the cavity for moving the antenna into a retracted position when the at least one antenna contact is not displaced away from the at least one swivel collar contact.

7. The system of claim 6 further comprising:

a satellite transceiver coupled to said at least one swivel collar contact of said swivel collar.

8. A system for connection of an antenna to a mobile radio comprising:

a housing;

a swivel collar coupled to the housing and swivelable relative to the housing for swiveling the antenna when in an extended position;

an opening in the swivel collar alignable with a cavity in the housing for retraction of the antenna through the opening into the housing;

a first locking structure on said swivel collar; and a second locking structure on said housing, wherein said first and second locking structures cooperate to fix an angle of rotation of the swivel collar relative to the housing.

9. The system of claim 8 further comprising:

an antenna matching circuit in said swivel collar.

10. A system for connection of an antenna to a mobile radio comprising:

a housing;

the antenna including at least one antenna contact at a basal end thereof;

a swivel collar slidably coupleable with the antenna and including at least one swivel collar contact alignable with the at least one antenna contact when the antenna is in an extended position, the swivel collar being rotatable in at least one direction when the antenna is in the extended position;

a first locking structure on said swivel collar; and a second locking structure on said horsing, wherein said first locking structure and said second locking structure cooperate to fix an angle of rotation of the swivel collar relative to the housing.

11. The system of claim 10 further comprising:

a cavity enveloping said antenna when said at least one antenna contact is displaced away from said at least one swivel collar contact.

12. The system of claim 10 further comprising:

an antenna coupler/connector insertable into said swivel collar, the antenna coupler/connector including an end for displacing the at least one antenna contact away from the at least one swivel collar contact, the antenna coupler/connector including at least one contact pad alignable with the at least one swivel collar contact when the at least one antenna contact is displaced away from the at least one swivel collar contact.

13. The system of claim 10 further comprising:

a docking adaptor, the docking adaptor including an antenna coupler/connector.

14. A method of operation of an antenna in a mobile radio comprising:

moving the antenna by rotating the antenna with a swivel collar and then sliding the antenna within the swivel collar, the sliding including moving the antenna from an extended position to a retracted position including moving an antenna contact at a basal end of the antenna away from a swivel collar contact in the swivel collar; and fixing an angle of rotation of the swivel collar relative to a housing by fixedly coupling a first locking structure on said swivel collar to a second locking structure on said housing.

15. The method of operation of claim 14 wherein said moving of said antenna by sliding said antenna within said swivel collar includes moving said antenna into a cavity.

16. The method of operation of claim 14 further comprising the steps of:

moving said antenna from a depressed position to said retracted position using a spring, including decoupling said swivel contact in said swivel collar from a contact pad on an antenna coupler/connector;

moving said antenna from said retracted position to said extended position, including connecting said swivel collar contact in said swivel collar to said antenna contact at said basal end of the antenna; and rotating said antenna with said swivel collar.

17. The method of operation of claim 16 further comprising:

removing said antenna coupler/connector from said swivel collar.

18. The method of operation of claim 16 further comprising:

capacitively coupling said antenna contact to said swivel collar contact with said antenna in said retracted position, wherein the antenna is allowed to operate with at least limited performance in the retracted position.

19. A system for connection of an antenna to a mobile radio comprising:

a housing;

a swivel collar coupled to the housing and swivelable relative to the housing for swiveling the antenna when in an extended position;

an opening in the swivel collar alignable with a cavity in the housing for retraction of the antenna through the opening into the housing;

a first locking structure on said swivel collar; and a second locking structure on said housing, wherein said first locking structure and said second locking structure cooperate to fix an angle of rotation of the swivel collar relative to the housing.

* * * * *